US005127133A

United States Patent [19]

Brucker

[11] Patent Number: 5,127,133

[45] Date of Patent: Jul. 7, 1992

[54] WIRE-FORMED HINGE ASSEMBLY FOR A PIVOTABLE RAIN GUTTER

[76] Inventor: William S. Brucker, 1500 Providence Rd., Towson, Md. 21204

[21] Appl. No.: 696,156

[22] Filed: May 6, 1991

[51] Int. Cl.[5] ..... E05D 7/00

[52] U.S. Cl. ..... 16/373; 16/389

[58] Field of Search ..... 16/373, 387, 388, 389, 16/390, 391, 392; 52/11, 14, 15, 16; 248/48.1, 48.2

[56] References Cited

U.S. PATENT DOCUMENTS

| | | | |
|---|---|---|---|
| 441,429 | 11/1890 | Mahin | 248/48.1 |
| 623,369 | 4/1899 | Heib | 248/48.1 |
| 803,477 | 10/1905 | Flowers | 248/48.2 |
| 4,014,074 | 3/1977 | Faye | 16/392 |
| 4,309,792 | 1/1982 | Faye | 16/389 |
| 4,669,232 | 6/1987 | Wyatt | 16/389 |
| 4,745,657 | 5/1988 | Faye | 16/392 |

*Primary Examiner*—Lowell A. Larson
*Assistant Examiner*—Michael J. McKeon
*Attorney, Agent, or Firm*—Leonard Bloom

[57] ABSTRACT

A wire-formed hinge assembly for a pivotable rain gutter including a pair of wire-formed members. The first member, having an "L" shape, is stationary having a first leg mounted to a structure and a second leg extending outwardly from the structure. The second leg has a "U" shaped end remote from the structure, the end having a stud therein. The second member is substantially "U" shaped and is fitted around the gutter. The second member has a pair of upstanding legs which retain the gutter therebetween. A bight portion of the second member, connects the legs thereof. The legs terminate in hooks which engage the upper lips of the respective side walls of the gutter. The second member has a loop thereon in which is received the stud of the remote end of the second leg of the first member. The second member holding the gutter may pivot about the stud received in the loop. An optional "C" shaped retaining member is provided. The retaining member is pivotally mounted on the structure and the arms of the retaining member may be pivoted to extend over and under the rain gutter to prevent pivoted inversion of the rain gutter. A plurality of spaced apart first members, second members and retaining members may be provided to attach a length of rain gutter to a structure to permit pivotal inversion of the rain gutter to empty debris from the rain gutter.

11 Claims, 6 Drawing Sheets

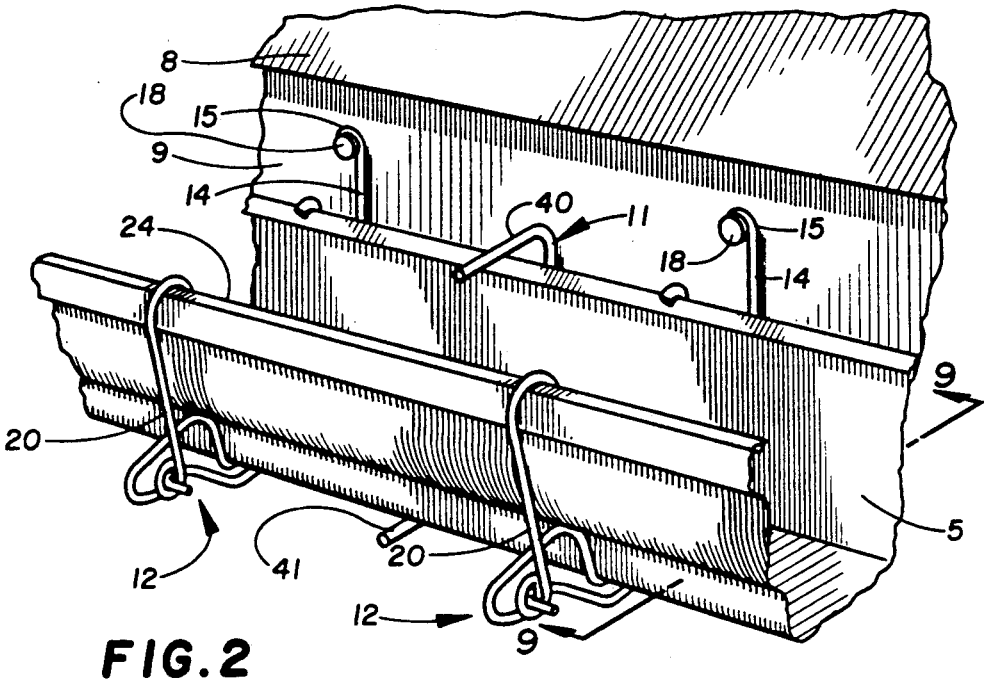
FIG. 2
FIG. 3
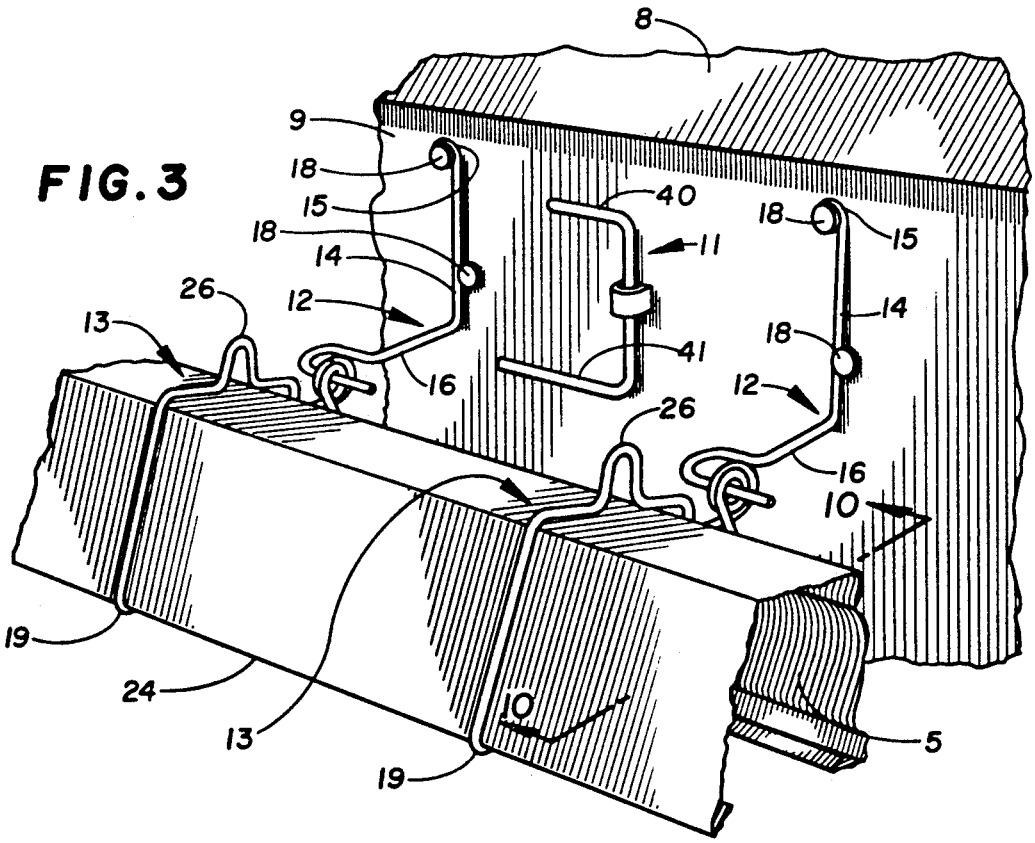

WIRE-FORMED HINGE ASSEMBLY FOR A PIVOTABLE RAIN GUTTER

FIELD OF THE INVENTION

The following invention relates to pivotable rain gutters and, more particularly to wire formed hinge assemblies and an assembly for mounting said gutters to a structure.

BACKGROUND OF THE INVENTION

Rain gutters have been used on structures for many years to collect the water run-off from the roof of the structure and to direct the water to a down spout so that the water may be led away from the structure. Problems have arisen with the water collection due to leaves, debris, etc., collecting in the rain gutters and interfering with the flow of water. The water may then overflow negating the purpose of the gutters, leakage into the foundation of the structure and rotting of wood adjoining the gutter.

In order to alleviate these problems, various devices have been disclosed which permit the gutters to be emptied periodically. Many of these approaches include means for tilting or inverting the rain gutter in order to empty the gutters. U.S. Pat. Nos. 510,515, 538,108, 984,716, 1,141,204, 3,630,473, 4,019,290, 4,061,151, 4,072,285, 4,116,008, 4,117,635, 4,441,108, 4,807,406 and 4,837,989 disclose this type of rain gutter. Some of these designs require specially designed gutters and complex tilting/rotating mechanisms. Most of the disclosed devices are relatively expensive and require special tooling for manufacture.

The hinge or pivoting mechanism required for a pivotable rain gutter has also been the subject of several U.S. Patents, namely U.S. Pat. Nos. 4,014,074, 4,309,792, 4,311,292, 4,413,449, 4,669,232, 4,745,657 and 4,813,190. These patents disclose substantially L-shaped brackets which are mounted vertically on the wall of the building, the lower leg of the bracket extending outwardly from the wall. The extremity of the lower leg has a hinge thereon to which is connected a second member. The gutter is attached to the second member by various means, differing in each reference. Several references disclose a fastener which penetrates the gutter. This feature aggravates corrosion and is a potential source of water leakage from the gutter. Other references disclose a strap-like member extending transversely across the top of the gutter. When the gutter is inverted to empty the debris which tends to felt or mat with the rise and fall of water in the gutter, the strap restricts movement of the debris and interferes with emptying of the gutter. Several of the references disclose members which are cut from aluminum or plastic extrusions which are specially tooled. The use of wire for support of a rain gutter has been disclosed and the use of wire to form a hinge has been disclosed in U.S. Pat. Nos. 235,859, 236,124, 423,287, 430,596, 602,846, 826,257, 983,362, 1,258,503 and 1,288,026.

However, the prior references have not suggested nor disclosed a simple wire hinge for use with a pivoted rain gutter. All of the referenced hinge assemblies have inherent problems therein as noted above. There remains a need for a simple, low cost, easily produced hinge assembly which retains the integrity of the rain gutter without obstructing the emptying of the gutter.

SUMMARY OF THE INVENTION

A principle object of the present invention is to provide a hinge assembly for use with a pivotable rain gutter which is inexpensive to fabricate and permits easy pivoting of the rain gutter.

A further object of the present invention is to provide a hinge assembly for use with a pivotable rain gutter which is formed of wire.

Another object of the present invention is to provide a hinge assembly for use with a pivotable rain gutter which retains the gutter without penetrating the gutter, thereby protecting the integrity of the gutter.

Yet another object of the present invention is to provide a hinge assembly for use with a pivotable rain gutter which has an inherent resiliency to accommodate tolerance accumulations between the hinge assembly and the gutter.

A still further object of the present invention is to provide an assembly for mounting a length of pivotable rain gutter to a structure, the assembly having a plurality of retainer members and a plurality of hinge assemblies.

In accordance with the teachings of the present invention, there is disclosed a wire-formed hinge assembly for a pivotable rain gutter, wherein the gutter is supported by a fascia board or the like adjacent to the roof of a structure. The gutter includes a substantially U-shaped member having a pair of side walls joined by a bottom wall. Each side wall has an upper lip. The hinge assembly includes a pair of wire-formed members including a first stationary member and a second member carried by the pivotable gutter. The first member includes a first leg secured to the fascia board and further includes a second leg extending beneath the gutter and having an end portion remote from the fascia board. The second member has a substantially U-shaped member fitted around the gutter and includes a bight portion and a pair of upstanding legs. Each leg terminates in an inwardly-turned hook, such that the upper lips of the side walls of the gutter are engaged within the respective hooks. The legs of the second member have an inherent resiliency so that the legs are retained on the respective side walls of the gutter, respectively and to overcome manufacturing tolerances in the gutter shape. Means are provided for pivotally securing the second wire-formed member to the end portion of the first wire-formed member remote from the fascia board.

Viewed in another aspect, the present invention provides an assembly for mounting a length of pivotable rain gutter to a fascia board or the like adjacent to the roof of a structure. The gutter includes a substantially U-shaped member having a pair of side walls joined by a bottom wall. Each side wall has an upper lip. The assembly includes a plurality of pivotable wire-formed retainer members and a plurality of wire-formed hinge assemblies. Each hinge assembly has a pair of wire-formed members including a first stationary member and a second member carried by the pivotable gutter. The first member of each hinge assembly includes a first leg secured to the fascia board and further includes a second leg extending beneath the gutter and having an end portion remote from the fascia board. The second member of each hinge assembly has a substantially U-shaped member fitted around the gutter and includes a bight portion and a pair of upstanding legs. Each leg terminates in an inwardly-turned hook, such that the upper lips of the side walls of the gutter are engaged within the respective hooks of each hinge assembly. The legs of the second member of each hinge assembly have an inherent resiliency so that the legs are retained on the respective side walls of the gutter. Means are provided for pivotally securing the second wire-formed member of each hinge assembly to the respective end portion of the first wire-formed member of each hinge assembly remote from the fascia board. The plurality of hinge assemblies are spaced apart along the length of the rain gutter to support the rain gutter. The pivotable retainer members may be spaced apart along the length of the rain gutter. Each retainer member may be pivotally mounted to the fascia board or the like such that each retainer member may be pivoted outwardly from the fascia board to prevent pivoting of the rain gutter and may be pivoted adjacent to fascia to permit pivoting of the rain gutter.

These and other objects of the present invention will become apparent from a reading of the following specification, taken in conjunction with the enclosed drawings.

BRIEF DESCRIPTION OF THE DRAWINGS

FIG. 2 is a perspective view showing the rain gutter retained in an upright position by the hinge assembly of the present invention.

FIG. 3 is a perspective view showing the rain gutter in an inverted position as held by the hinge assembly of the present invention.

DESCRIPTION OF THE PREFERRED EMBODIMENTS

Figure 1A:
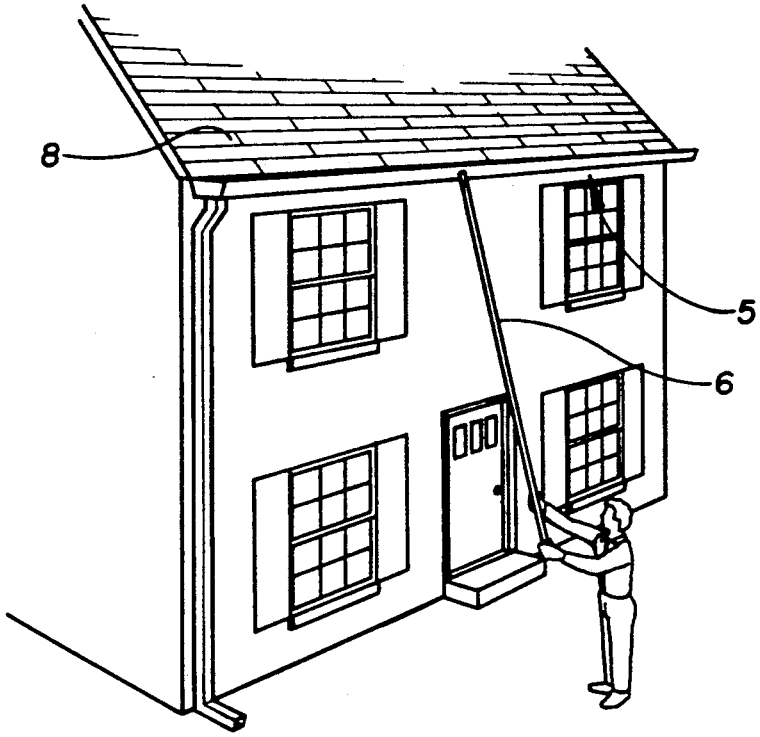
FIG. 1A is a perspective view of a typical use of the present invention wherein the rain gutter is in an upright position.
Figure 1B:
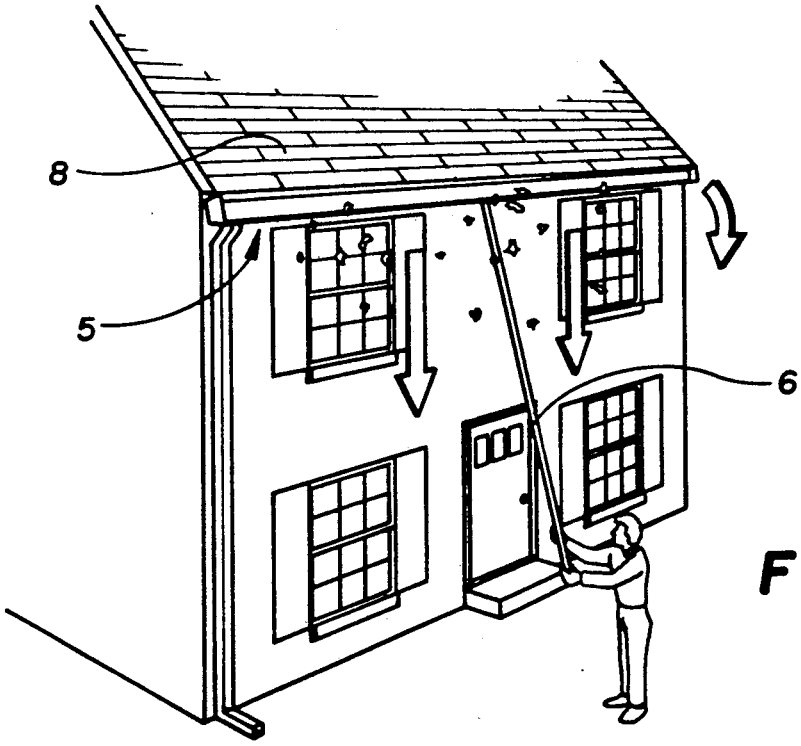
FIG. 1B is a perspective view of a typical use of the present invention wherein the rain gutter has been inverted.

Referring to FIGS. 1A and 1B, a structure is shown in a typical situation wherein debris such as leaves and the like has collected in the rain gutter 5. This debris obstructs the flow of water from the roof to the down spout so that the water may overflow and damage the structure and the foundation of the structure. A person having a long handled tool 6 pivots the optional retaining member so that the rain gutter 5 may, in turn, pivot. The long handled tool 6 is used to invert the gutter 5 so that the gutter 5 pivots to be inverted about the hinge assembly 10. When so inverted, the debris empties from the rain gutter 5, the person then pushes the edge of the rain gutter 5 upwardly to pivotally reset the rain gutter 5 in its upright position. The long handled tool 6 may also be used to pivot the retaining member 11 to "unlock" the device.

As shown in FIG. 2, the rain gutter 5 is mounted on the fascia board 9 or the like adjacent to the roof 8 of a structure. A plurality of spaced apart hinge assemblies 10 are mounted to the fascia board 7 and each assembly extends beneath the bottom wall of the substantially U-shaped rain gutter. A plurality of C-shaped retaining members 11 may be pivotally mounted on the fascia board 9 and are pivotable so that the top and bottom arms of each "C" shape extend outwardly above and below the rain gutter 5 to prevent inversion of the rain gutter 5.

Figure 4:
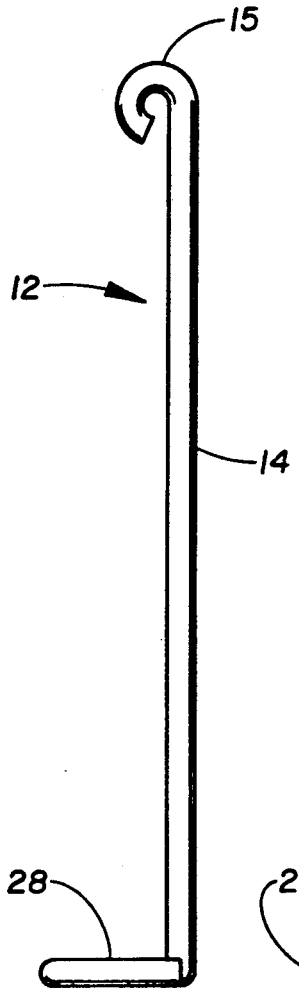
FIG. 4 is a front view of the first stationary member of the present invention.
Figure 5:
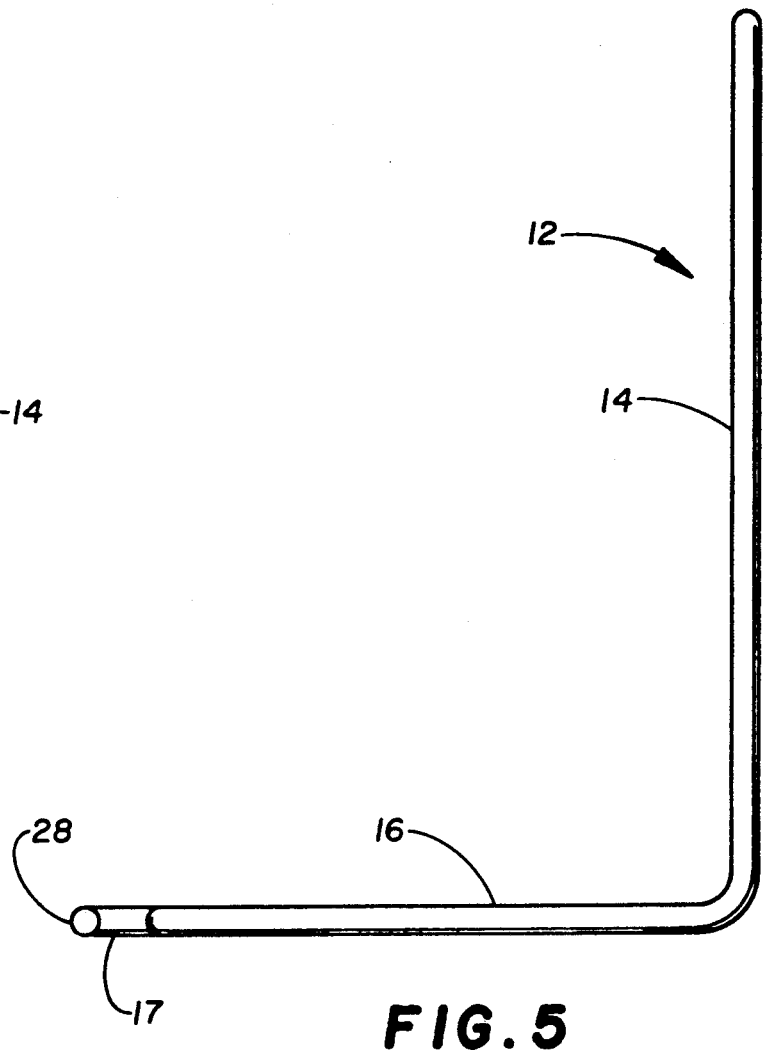
FIG. 5 is a side view of the first stationary member of the present invention.
Figure 6:
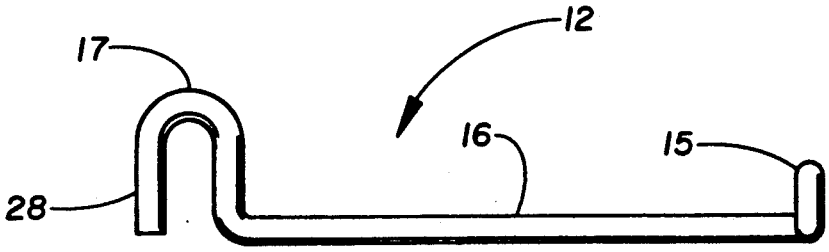
FIG. 6 is a top view of the first stationary member of the present invention.
Figure 7:
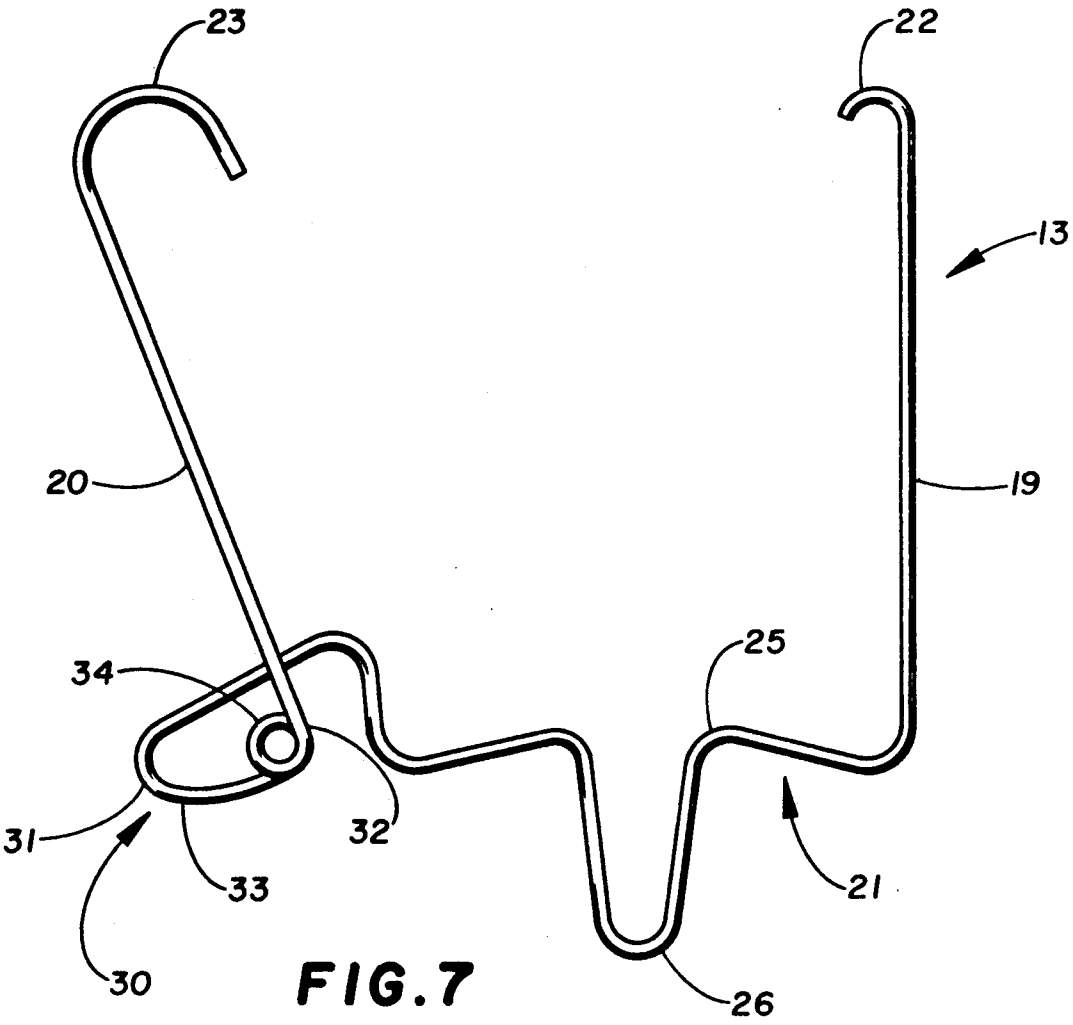
FIG. 7 is a plan view of the second member of the present invention.

Referring to FIG. 3, the rain gutter 5 is shown in an inverted position. Each hinge assembly 10 comprises a pair of wire-formed members, a first member 12 and a second member 13. The first member 12 is stationary and is formed in a substantially L-shape (FIGS. 4, 5 and 6). An upright first leg 14 of the first member is secured to the fascia board 7 substantially perpendicular to the roof. In a preferred embodiment, at least one eyelet 15 is formed on the first leg 14 and fastening means such as a nail, screw or the like 18 passes through the respective eyelet 15 and into the fascia board 9. The eyelet 15 may be a formed loop, coined or pierced flats in configuration. Other means of securing the first leg 14 to the fascia board 9 may be used. The second leg 16 of the stationary first member 12 is substantially perpendicular to the first leg 14 and extends outwardly from the fascia board 7, beneath the rain gutter 5. The second leg 16 has an end portion 17 remote from the fascia board 5. The end portion 7 is formed in the shape of a "U" and has a projecting stud 28 which is substantially at right angles to the second leg 15. When the first member 12 is mounted on the fascia board 7, the "U" on the end portion 17 and the stud 28 thereon, is substantially parallel with the rain gutter 5. As shown in FIG. 7, the second member 13 is substantially U-shaped and as such, fits around the substantially U-shaped rain gutter 5. The second member 13 has a pair of upstanding legs. 19, 20 and a connecting base 21 therebetween. The rear leg 19 of the second member 13 extends upwardly along the inner side wall of the rain gutter 5 adjacent to the structure when the rain gutter 5 is in an upright position. The rear leg terminates in a hook 22 which is turned inwardly over the upper lip of the inner sidewall of the rain gutter 5. The front leg 20 of the second member 13 extends upwardly along the outer side wall of the rain gutter 5, remote from the structure. The front leg 20 terminates in an inwardly-turned hook 23. The hook 23 on the front leg is arcuate so as to engage the upper lip 24 of the outer wall of the rain gutter 5. The arcuate hook 23 retains the rain gutter 5 when the rain gutter is in the inverted position. The legs 19, 20 have an inherent resiliency to retain the legs 19, 20 on the respective side walls of the rain gutter. The base 21 of the second member 13 includes a bight portion 25. In approximately the midsection of the bight portion 25, there is formed a laterally-offset portion 26. The bight portion 25 is disposed substantially adjacent to the bottom wall of the rain gutter 5. The laterally-offset portion 26 provides an inherent resiliency into the second member 13 such that the second member 13 fits snugly about the rain gutter 5. This manner of fit accommodates tolerance accumulations between the hinge assembly 10 and the rain gutter 5. Thus, costs incurred in fabrication of extruded hinges of the prior art are alleviated in the hinge of the present invention.

The second member 13 further has a triangularly shaped portion 30 which is formed in the front leg 20 of the second member 13. The triangularly shaped portion 30 is adjacent to the bight portion 25 of the second member 13. The triangularly shaped portion 30 has an apex 31 which extends outwardly from the second member 13 and is substantially perpendicular to the rain gutter 5. Opposite to the apex 31, the triangularly shaped portion has a base 32 and a lower leg 33 is disposed between the base 32 and the apex 31. A loop 34 is formed in the base 32 of the triangularly shaped portion 30. When the second member 13 is mounted on the rain gutter 5, the stud 28 on the U-shaped end portion 16 of second leg 15 of the stationary first member 12, is received in the loop 34. In this manner, the second member 13 of the hinge assembly 10 is pivotally secured to the first member 12 of the hinge assembly 10. When the rain gutter 5 is inverted (FIGS. 3 and 10) the lower leg 3 of the triangularly shaped portion 30 engages the U-shaped end portion 16 of the second leg 15 of the first member 12. When so engaged, further pivotal movement of the rain gutter 5 is restricted; the contact between the leg 33 of the triangle and the end portion 17 acting as a stop.

Figure 8:
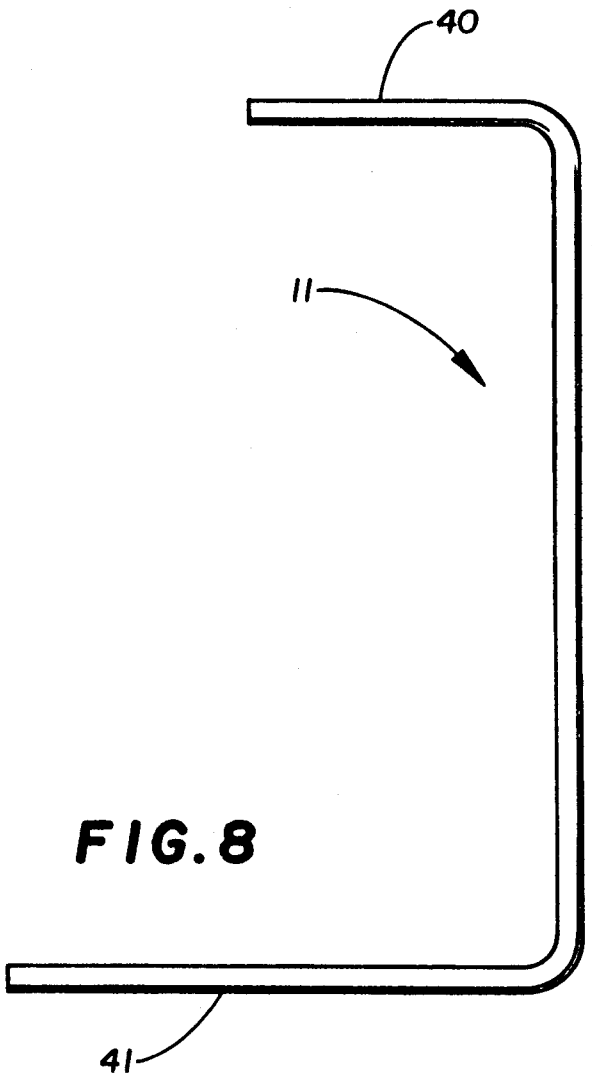
FIG. 8 is a side view of the retainer member of the present invention.

The optional retaining member 11 is "C" shaped (FIG. 8), having a top arm 40, a bottom arm 41 and a center portion 42 therebetween. The top arm 40 is shorter than the bottom arm 41. The center portion 42 is pivotally mounted on the fascia board 9. The mounting means are commonly known to persons skilled in the art and are not described in detail herein. The retaining members 11 are thus pivotally movable so that the arms 40, 41 may be disposed adjacent to the fascia board 9 and may be pivoted to be disposed substantially perpendicular to the fascia board 9. When in a perpendicular portion, the arms 40, 41 are above and below the rain gutter 5. When so disposed, inversion of the rain gutter 5 is prevented. This option is especially useful in regions where there are high winds and/or heavy snow loads and where additional locking and support may be useful.

The wire-formed second member 13 is preferably fabricated from cold drawn steel with a diameter of approximately 0.064–0.072 in. In a preferred embodiment, the wire is heat treated to improve the spring-like characteristics. If desired to improve weatherability and to add corrosion resistance and/or appearance, the assembly may be coated with a material, such as vinyl.

Figure 9:
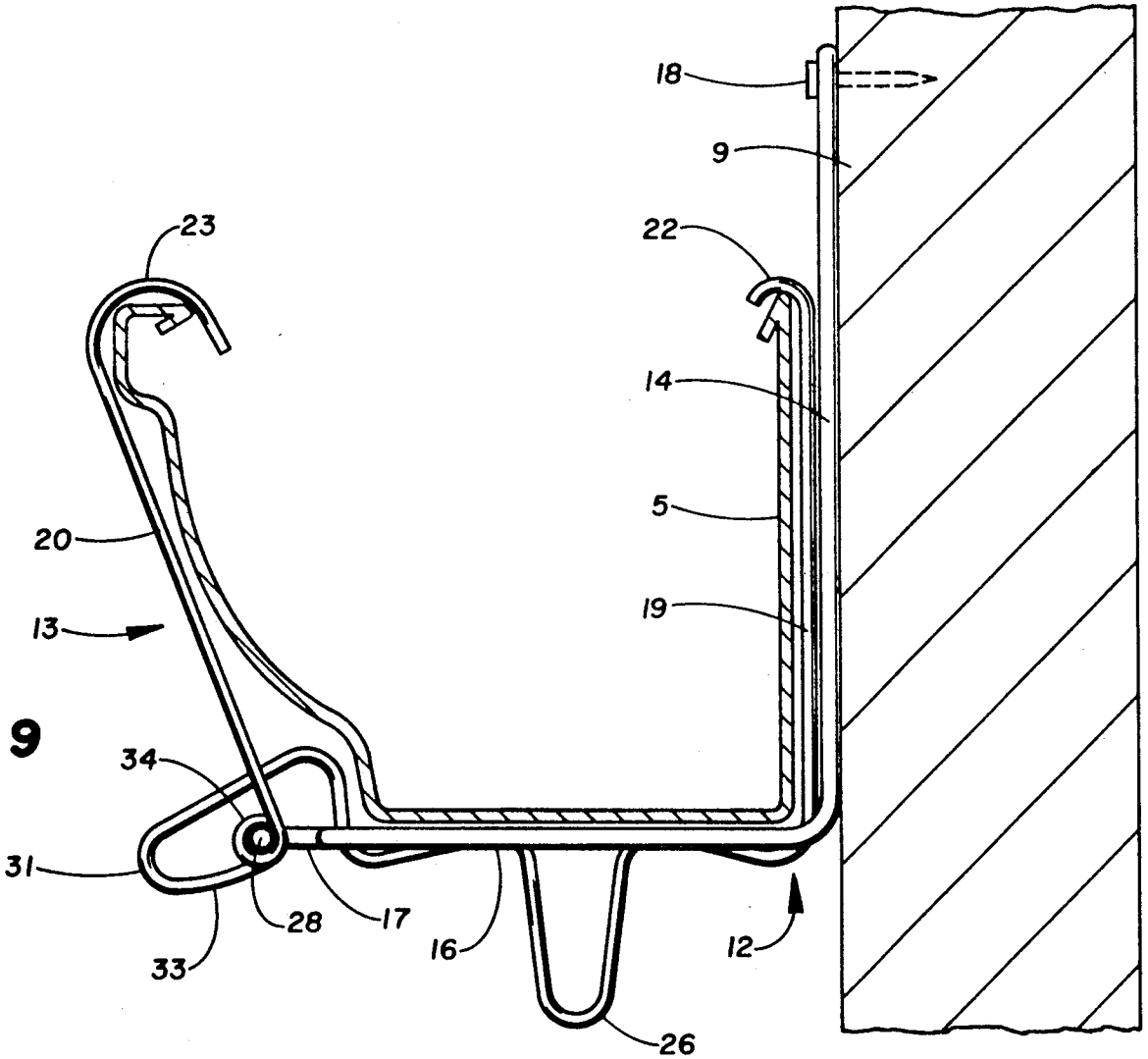
FIG. 9 is a cross section taken across lines 9—9 of FIG. 2.
Figure 10:
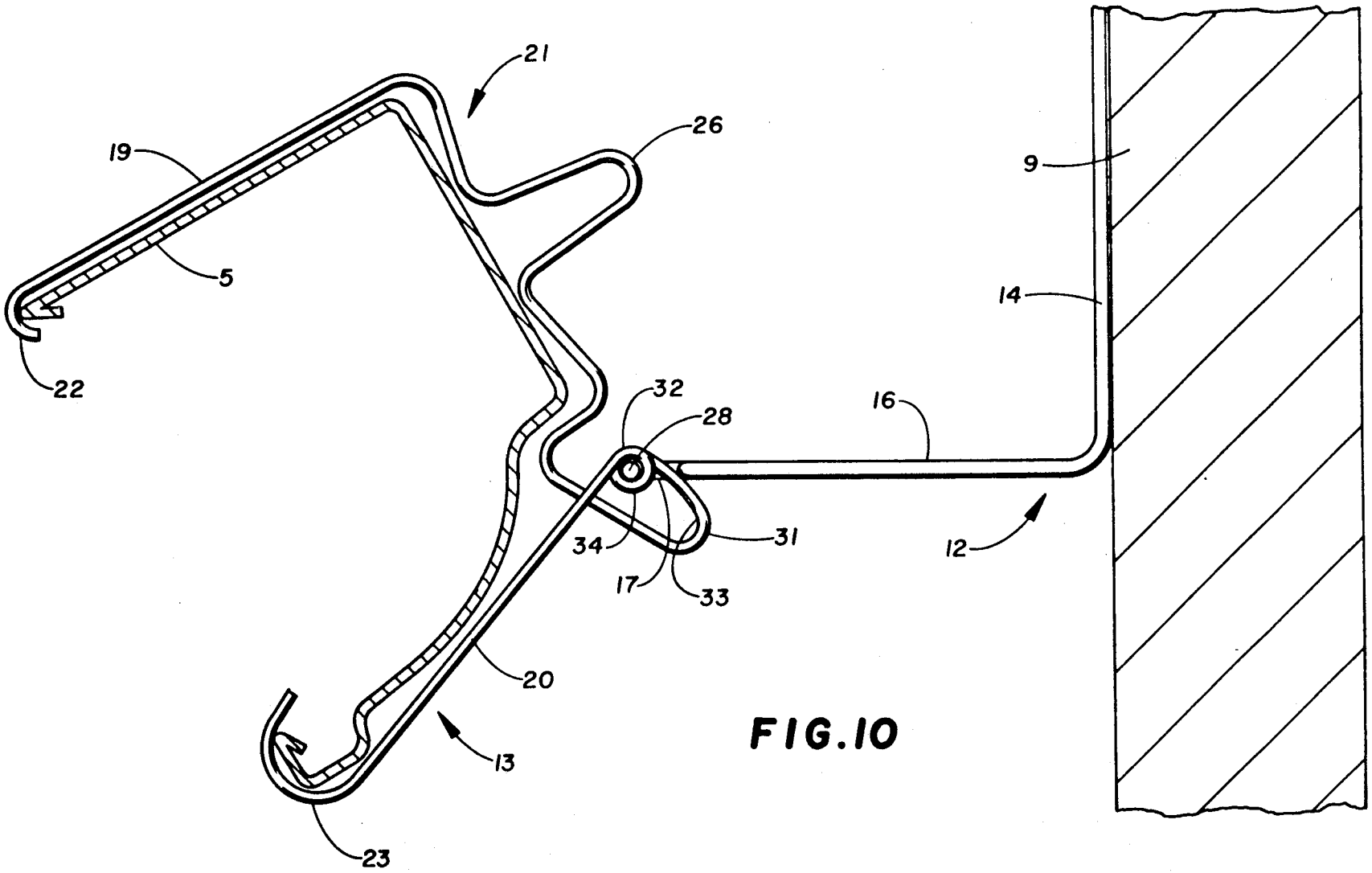
FIG. 10 is a cross section taken across lines 10—10 of FIG. 3.

Having described the assembly, the use of the hinge assembly is herein described (FIGS. 9 and 10). The retaining members 11 are mounted on the fascia board 7 with a desired space between the individual members and with the arms 40, 41 disposed adjacent to the fascia board 7. The stationary first members 12 are mounted on the fascia board 9 with a desired space between the members and with a space between the individual retaining members 11 and the first members 12. The second members 13 are disposed on the rain gutter 5 spaced apart at distances corresponding to the distances between the first members 12. The gutter 5 is pivotally mounted on the structure by engaging the respective loops 34 in the triangularly shaped portion 30 of each second member on the respective "U" shaped end portion 16 of each first member 12. The retaining members 11 are pivoted so that the arms 40, 41 are disposed perpendicularly to the fascia board 7 and prevent the rain gutter 5 from being inverted. As shown in FIGS. 1A and 1B when the rain gutter 5 is obstructed with debris, a person using a long handled tool 6 with a suitable fitting on the end thereof, moves the retaining members 11 to the position where the arms 40, 41 are adjacent to the fascia board 9. The long handled tool 6, in one embodiment, is then pushed or pulled against the base of the rain gutter 5 adjacent to the inner side wall of the rain gutter. The rain gutter 5, as held by the second member 13, pivots about the stud 28 on the remote end 17 of the stationary member 12, to become inverted. The stop bend on the second member 12, limits movement of the hinge assembly and the rain gutter 5 to approximately 180°, facilitating return to an upright position. When all the debris has been emptied from the rain gutter, the long handled tool 6 is pushed against the lip of the outer wall 24 of the rain gutter 5 near the pivot where the arcuate hook 23 on the second member 13 engages the rain gutter 5. The rain gutter 5 pivots about the stud 28 on the end portion 17 of the first member 12 which is received in the loop 34 in the triangular portion of the second member 13.

When the rain gutter 5 is inverted, the entire contents of the rain gutter 5 are completely emptied because the present invention does not have any braces or members which extend across the upper portion of the rain gutter between the side walls thereof. The present invention holds the rain gutter 5 by resilient means around the outer surface of the rain gutter 5. Further, the present invention is fabricated from inexpensive cold rolled steel wire which has been formed to provide resiliency to more effectively hold the rain gutter 5. The resiliency accommodates the tolerance of the rain gutter and of the hinge assembly and there is no need to provide expensive custom tooling to manufacture the present invention. Furthermore, expensive, complex means for tilting or rotating the rain gutters are not required.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A wire-formed hinge assembly for a pivotable rain gutter, wherein the gutter is supported by a fascia board or the like adjacent to the roof of a structure, and wherein the gutter comprises a substantially U-shaped member having a pair of side walls joined by a bottom wall, each side wall having an upper lip, the hinge assembly comprising a pair of wire-formed members including a first stationary member and a second member carried by the pivotable gutter, the first member having an "L" shape including a first leg secured to the fascia board and further including a second leg extending beneath the gutter and having an end portion remote from the fascia board, the second member comprising a substantially U-shaped member fitted around the gutter and including a bight portion and a pair of upstanding legs, a front leg and a rear leg, each leg terminating in an inwardly-turned hook, such that the upper lips of the side walls of the gutter are engaged within the respective hooks, the legs of the second member having an inherent resiliency so that the legs are retained on the respective side walls of the gutter, and tolerance deviations between the hinge assembly and the gutter are accommodated and means for pivotally securing the second wire-formed member to the end portion of the first wire-formed member remote from the fascia board.

2. The wire-formed hinge assembly of claim 1, wherein the bight portion of the second member has a laterally-offset portion which is disposed substantially adjacent to the bottom wall of the gutter and provides an inherent resiliency, thereby accommodating tolerance deviations between the hinge assembly and the gutter.

3. The wire-formed hinge assembly of claim 1, wherein each of the members further comprises a steel wire having a vinyl coating thereon.

4. The wire-formed hinge assembly of claim 1, wherein the means for securing the first leg of the first member to the fascia board comprises an eyelet formed on the first leg, and fastening means passing through the eyelet and into the fascia board.

5. The wire-formed hinge assembly of claim 4, further including a second eyelet formed on the first leg of the first member, and second fastening means passing through the second eyelet and into the fascia board.

6. The wire-formed hinge assembly of claim 1, wherein the means for pivotally mounting the second wire-formed member to the end portion of the first wire-formed member remote from the fascia board comprises an eyelet formed on the second member, and the end portion of the first member having a projecting stud extending substantially at right angles to the second member, substantially parallel to the gutter, and received within the eyelet of the second member.

7. The wire-formed hinge assembly of claim 1, further comprising a substantially triangularly shaped portion formed in the first leg of the second member adjacent to the bight portion, the triangular shaped portion having an apex extending outwardly from the second member and substantially perpendicular to the rain gutter.

8. The wire-formed hinge assembly of claim 7, further comprising the triangularly shaped portion having a base opposite to the apex thereof, and a lower leg between the apex and the base, the base having a loop formed therein, the remote end portion of the second leg of the first member being formed in a U-shape, the U-shaped remote end portion being received in the loop in the base, wherein the second member of the hinge assembly is pivotally connected to the first member of the hinge assembly and wherein, when the rain gutter is inverted, the lower leg of the triangularly shaped portion engages the end portion of the second leg of the first member such that pivotal movement of the rain gutter is limited.

9. The wire-formed hinge assembly of claim 1, wherein the rear upstanding leg is adjacent to the structure and the front upstanding leg is remote from the structure, the inwardly turned hook on the front leg having an arcuate bend therein, wherein the respective side wall of the rain gutter may be retained within the arcuate bend when the rain gutter is pivoted about the end portion of the first wire-formed member.

10. An assembly for mounting a length of pivotable rain gutter to a fascia board or the like adjacent to the roof of a structure, and wherein the gutter comprises a substantially U-shaped member having a pair of side walls joined by a bottom wall, each side wall having an upper lip, the assembly comprising a plurality of pivotable wire-formed retainer members and a plurality of wire formed hinge assemblies, each hinge assembly having a pair of wire-formed members including a first stationary member and a second member carried by the pivotable gutter, the first stationary member of each hinge assembly having an "L" shape including a first leg secured to the fascia board and further including a second leg extending beneath the gutter and having an end portion remote from the fascia board, the second member of each hinge assembly comprising a substantially U-shaped member fitted around the gutter and including a bight portion and a pair of upstanding legs, each leg terminating in an inwardly-turned hook, such that the upper lips of the side wall of the gutter are engaged within the respective hooks of each hinge assembly, the legs of the second member of each hinge assembly, the legs of the second member of each hinge assembly having an inherent resiliency so that the legs are retained on the respective side walls of the gutter, and tolerance deviations between the hinge assembly and the gutter are accommodated, means for pivotally securing the second wire-formed member of each hinge assembly to the respective end portion of the first wire-formed member of each hinge assembly remote from the fascia board, the plurality of hinge assemblies being spaced apart along the length of the rain gutter to support the rain gutter; the pivotable retainer members being spaced apart along the length of the rain gutter, each retainer member being pivotally mounted to the fascia board or the like such that each retainer member may be pivoted outwardly from the fascia board to prevent pivoting of the rain gutter and may be pivoted adjacent to fascia to permit pivoting of the rain gutter.

11. The assembly for mounting a rain gutter of claim 10, further comprising each retainer member being substantially C-shaped having a center portion, an upper portion and a lower portion, the upper portion and lower portion each being substantially perpendicular to the center portion, the center portion being pivotally mounted to the fascia board or the like, the center portion being substantially perpendicular to the rain gutter, wherein when the respective retainer member is pivoted outwardly, the upper portion extends over the rain gutter and the lower portion extends under the rain gutter.

* * * * *